United States Patent [19]

Peters

[11] 4,402,502

[45] Sep. 6, 1983

[54] EXERCISER FOR DISABLED PERSONS

[75] Inventor: Gilbert E. Peters, Ladysmith, Wis.

[73] Assignee: Industrial Energy Specialists, Inc., Ladysmith, Wis.

[21] Appl. No.: 250,619

[22] Filed: Apr. 3, 1981

[51] Int. Cl.[3] ..... A63B 23/04

[52] U.S. Cl. ..... 272/73; 128/25 R; 272/143; 272/900

[58] Field of Search ..... 272/73, 143; 128/133, 128/134, 135, 25 R; 74/594.1, 594.2, 594.4, 594.5, 594.6, 594.7, 570, 545, 546

[56] References Cited

U.S. PATENT DOCUMENTS

| | | | |
|---|---|---|---|
| 583,920 | 6/1897 | Montgomery | 128/25 |
| 1,323,004 | 11/1919 | Boyd | 74/594.4 X |
| 2,696,206 | 12/1954 | Bierman | 128/25 R |
| 2,735,422 | 2/1956 | Jones | 128/25 R |
| 2,784,591 | 3/1957 | Shoor | 272/73 |
| 2,832,334 | 4/1958 | Whitelaw | 128/25 R |
| 3,057,201 | 10/1962 | Jaeger | 272/73 X |
| 3,213,852 | 10/1965 | Zent | 128/25 |
| 3,216,722 | 11/1965 | Odom | 272/73 |
| 3,572,699 | 3/1971 | Nies | 272/73 |
| 3,713,438 | 1/1973 | Knutsen | 128/25 R |
| 3,727,913 | 4/1973 | Glaser et al. | 128/25 R X |
| 3,788,163 | 1/1974 | Gause | 128/25 R X |
| 3,824,993 | 7/1974 | Grant | 128/25 R |
| 3,910,571 | 10/1975 | Stenn | 272/58 |
| 3,964,742 | 6/1976 | Carnielli | 272/73 |
| 3,991,749 | 11/1976 | Zent | 128/25 R |
| 4,071,235 | 1/1978 | Zent | 272/73 |
| 4,169,591 | 10/1979 | Douglas | 128/25 R X |
| 4,222,376 | 9/1980 | Praprotnik | 128/25 R |

FOREIGN PATENT DOCUMENTS

| | | | |
|---|---|---|---|
| 511847 | 6/1952 | Belgium | 74/594.1 |
| 2021130 | 9/1971 | Fed. Rep. of Germany | 272/73 |
| 467140 | 11/1951 | Italy | 74/594.1 |
| 857763 | 10/1958 | United Kingdom . | |
| 2016286 | 2/1979 | United Kingdom . | |
| 427696 | 2/1975 | U.S.S.R. | 272/73 |

*Primary Examiner*—Richard C. Pinkham
*Assistant Examiner*—Arnold W. Kramer
*Attorney, Agent, or Firm*—Andrus, Sceales, Starke & Sawall

[57] ABSTRACT

In an exerciser, limb supports are provided for reducing limb spasms during exercising and holding the limbs in place. The lower supports are adapted for attachment to the foot pedals and are generally L-shaped in section for supporting the foot and calf of the leg. A tether holds the support in position when it is not in use. The upper supports are removably secured to the hand grips and support the operator's wrist and forearm. Both supports are strapped to the appropriate limb. The motorized drive for the lower and upper crank arms includes a clutch of the overriding type so that the operator can temporarily use muscle power to turn the hand cranks faster than the speed of the motor drive itself without deactivating the motor drive or disengaging the clutch or changing the drive of the pedals. The exerciser is fixedly mounted on a platform which is of a size sufficient to receive a wheelchair so that a wheelchair confined person can have the benefits of the device. The exerciser includes a fully protective housing extending from the top of the drive mechanism to the bottom supporting platform, with the housing including upper and lower telescoping portions. The upper housing portion, together with its internal mechanism, is pivotable relative to the lower housing portion to provide fore-and-aft adjustment of the upper crank arms.

4 Claims, 5 Drawing Figures

EXERCISER FOR DISABLED PERSONS

U.S. PRIOR ART OF INTEREST

| Number | Inventor | Issue Date |
|---|---|---|
| 583,920 | Montgomery | June 8, 1897 |
| 3,213,852 | Zent | Oct. 26, 1965 |
| 3,216,722 | Odom | Nov. 9, 1965 |
| 3,572,699 | Nies | Mar. 30, 1971 |
| 3,824,993 | Grant | July 23, 1974 |
| 3,964,742 | Carnielli | June 22, 1976 |
| 3,991,749 | Zent | Nov. 16, 1976 |
| 4,071,235 | Zent | Jan. 31, 1978 |

BACKGROUND AND SUMMARY OF THE INVENTION

This invention relates to an exerciser for disabled persons such as paraplegics, quadraplegics and the like.

Various types of exercise devices have long been known for providing therapeutic treatment for children and adults who have different degrees of disabilities, as well as for providing healthful exercise. The above-identified U.S. patents are representative of such devices.

The known devices have been subject to a number of disadvantages. For example, some persons tend to develop spasms in their limbs during use of the prior exercisers. Furthermore, as the ability to use the limbs improves, the person may wish to use his own muscle power to turn the hand cranks on a temporary basis, and not rely on motorized driving. In devices such as above U.S. Pat. No. 3,824,993, which use a motor and clutch drive, the motor and/or clutch must be disengaged to provide the desired free wheeling. This is disadvantageous to one who wishes to "try his own wings" with his arms for only a few seconds or minutes at a time. In addition, the known prior devices include an attached seat for the operator, thus making them impossible for use by a wheelchair confined person. Also, while highly desirable fully protective housings for the apparatus are known, as in U.S. Pat. No. 3,991,749, fore-and-aft adjustment of the hand crank arms with such a housing have previously not been possible.

The present invention is directed to overcoming the above-described disadvantages.

In accordance with one aspect of the invention, limb supports are provided for reducing limb spasms during exercising and holding the limbs in place. The lower supports are adapted for attachment to the foot pedals and are generally L-shaped in section for supporting the foot and calf of the leg. A tether holds the support in position when it is not in use. The upper supports are removably secured to the hand grips and support the operator's wrist and forearm. Both supports are strapped to the appropriate limb.

In accordance with another aspect of the invention,- the motorized drive for the lower and upper crank arms includes a clutch of the overriding type so that the operator can temporarily use muscle power to turn the hand cranks faster than the speed of the motor drive itself without deactivating the motor drive or disengaging the clutch or changing the drive of the pedals.

In accordance with a further aspect of the invention, the exerciser is fixedly mounted on a platform which is of a size sufficient to receive a wheelchair so that a wheelchair confined person can have the benefits of the device.

In accordance with yet another aspect of the invention, the exerciser includes a fully protective housing extending from the top of the drive mechanism to the bottom supporting platform, with the housing including upper and lowr telescoping portions. The upper housing portion, together with its internal mechanism, is pivotable relative to the lower housing portion to provide fore-and-aft adjustment of the upper crank arms.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 3:
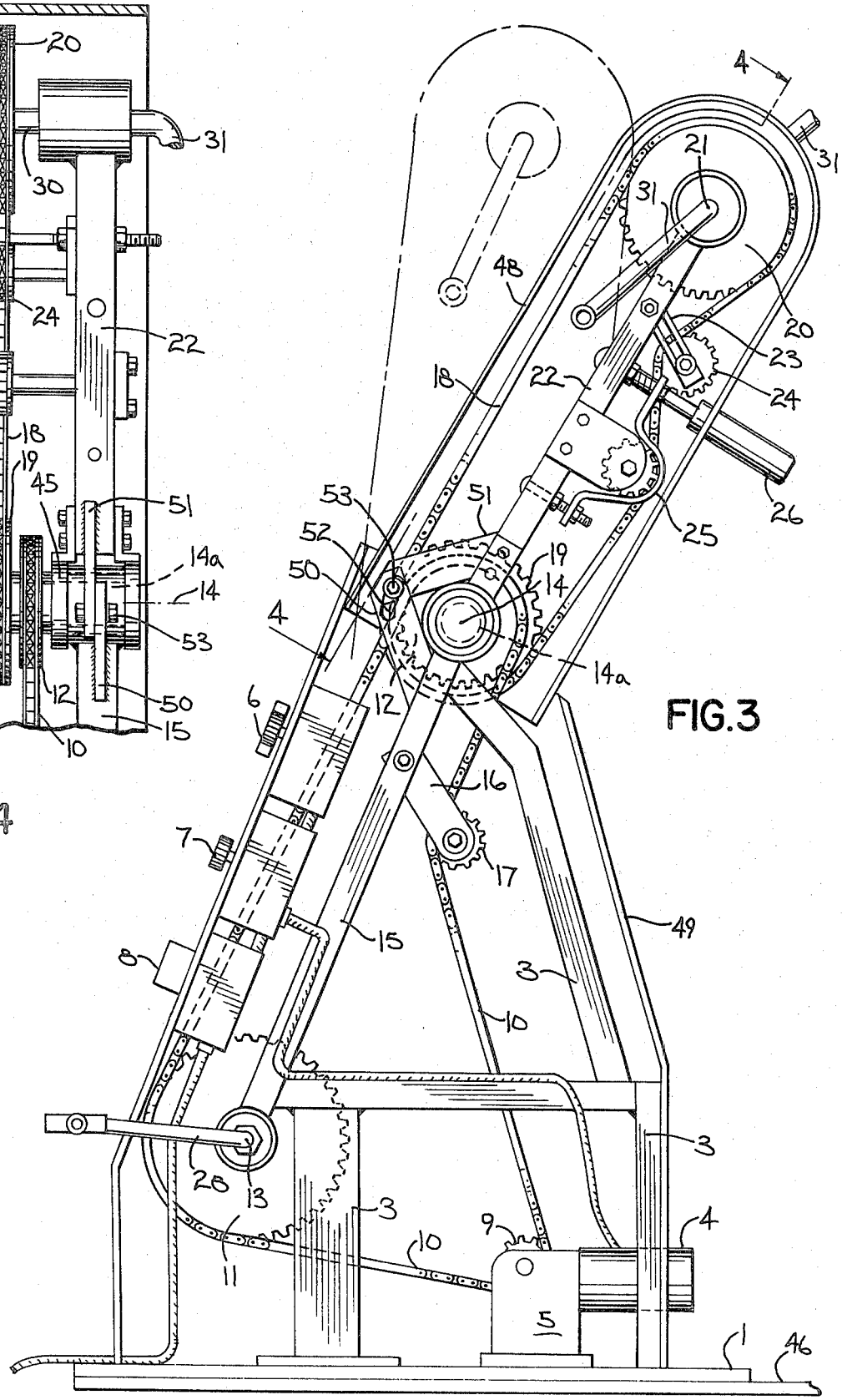
FIG. 3 is a generally central vertical section of the exerciser.

As shown in the drawings, the exerciser of the invention includes a base 1 and a housing 2 extending upwardly from said base for protectively enclosing the working mechanism of the device. Referring to FIG. 3, a fixed frame 3 is mounted on base 1, as is a combination drive motor 4 and speed reducer 5. Suitable controls for motor 4 may be mounted exteriorly of housing 2 and may comprise a combination on-off time switch 6, a speed control 7 and a fuse box 8.

Speed reducer 5 has a drive sprocket wheel 9 over which is trained a lower drive element such as an endless chain 10. Chain 10 extends forwardly from sprocket wheel 9 and passes directly under a lower sprocket wheel 11 and then upwardly and over an intermediate sprocket wheel 12. Sprocket wheels 11 and 12 are mounted for rotation about respective axes 13 and 14 at the ends of a fixed angularly upwardly extending strut 15 which is secured to frame 3. Below axis 14, a short arm 16 extends downwardly and rearwardly from strut 15 and carries an idler sprocket wheel 17. Chain 10 extends between sprocket wheels 12 and 9 and over sprocket wheel 17, which is designed, by changing the angle of inclination of arm 16, to adjust the chain tension.

An upper drive element, such as an endless chain 18, extends from a second intermediate sprocket wheel 19 on axis 14 and upwardly within housing 2 to an upper sprocket wheel 20 mounted for rotation on an axis 21. Sprocket wheels 19 and 20 are mounted for rotation on and joined by a strut 22, the lower end of which is mounted coaxially on axis 14 and its shaft **14*a* with the upper end of strut 15. Below axis 21, a short arm 23 extends downwardly and rearwardly from strut 22 and carries an adjustable idler sprocket wheel 24, similar to sprocket wheel 17 over which chain 18 extends. A friction chain brake 25 of any suitable well-known type is disposed below idler sprocket wheel 24 on strut 22 and is adjusted for tightness as by a rotatable adjustment mechanism 26**.

Keyed for direct drive rotation with lower sprocket wheel 11 on axis 13 is a spindle 27 which carries on its ends the usual pedal cranks 28 having foot pedals 29 rotatable thereon. Likewise, keyed for rotation with upper sprocket wheel 20 on axis 21 is a spindle 30 which carries on its ends the usual hand cranks 31 having graspable cylindrical open-ended handles 32 thereon.

Figure 1:
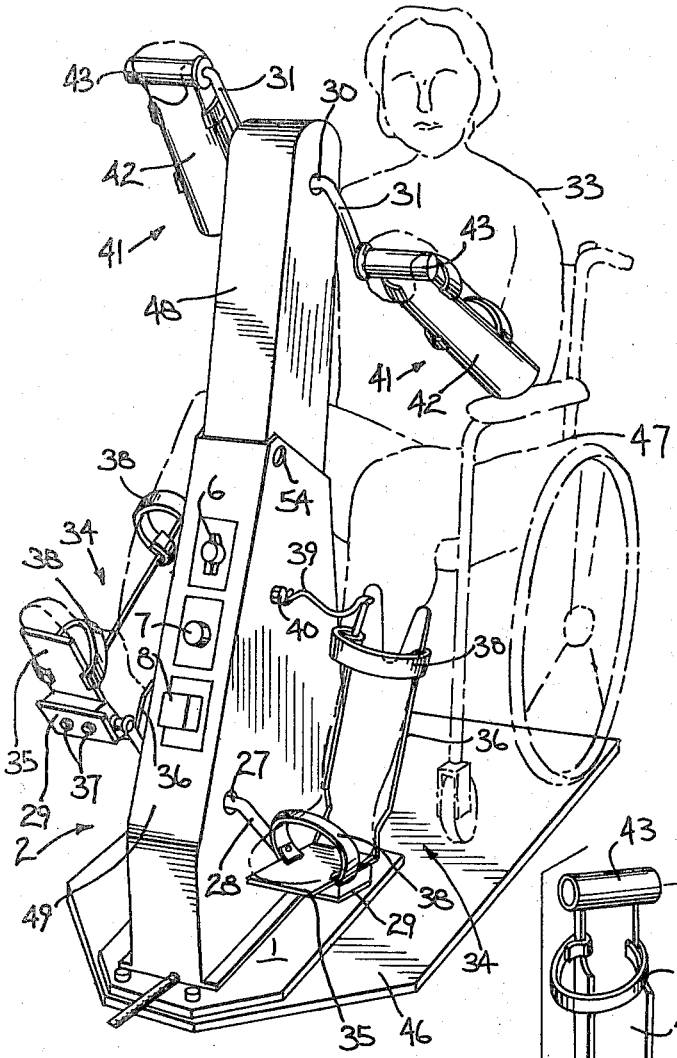
FIG. 1 is a front perspective view of an exerciser constructed in accordance with the invention, and showing it in use by a disabled person.

In operation of the exerciser, and referring to FIG. 1, the operator 33 is positioned adjacent the device so that his arms and/or legs can rotate in conjunction with the respective crank arms 31 and 28. Depending upon the degree of disability of the operator, his hands and feet may freely cooperate with the respective crank arms, or his limbs may have to be attached thereto if he has no muscular strength.

In any event, support means are provided to reduce spasms which may occur in the operator's limbs during exercising.

In the case of the operator's legs, at least one leg support 34 is provided, although in the present embodiment a support 34 is shown for each leg. Each support 34 comprises a generally L-shaped relatively rigid member of plastic or the like, and having a lower flat footrest portion 35 which merges into an elongated upper curved calf support portion 36. Portion 35 is secured to pedal 29 as by bolts 37. The operator's leg is placed in the support with his foot resting on portion 35 and his ankle and calf resting in portion 36. Straps 38 on the support extend over the arch of the operator's foot and over his leg.

Figure 2:
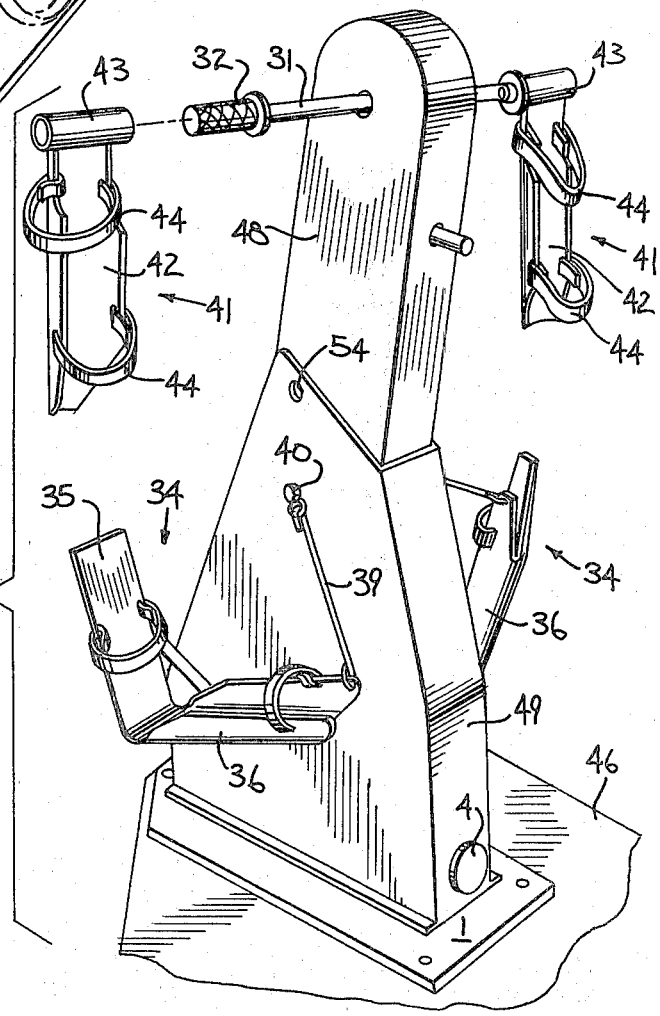
FIG. 2 is a rear perspective view of the exerciser with parts exploded for purposes of clarity.

When the exerciser is not in use, the unbalanced weight of leg support 34 is such that calf support portion 36 would pivot by gravity downwardly about the pedal axis and rest on base 1 where it could be damaged. To prevent this, a flexible tether 39 connects the upper portion of calf support portion 36 with a point 40 on housing 2 above spindle 27 so that portion 36 inclines upwardly from footrest portion 35 as shown in FIG. 2. Support 34 is free from restraint by the tether during exercising, as shown in FIG. 1.

In the case of the operator's arms, at least one arm support 41 is provided, although in the present embodiment, a support 41 is shown for each arm.

Each arm support 41 comprises an elongated rigid curved forearm support portion 42 of plastic or the like which terminates at one end in means for removable connection to handle 32. For this purpose and referring to FIG. 2, handle 32 is constructed of relatively soft material such as rubber which has ribs or serrations thereon. The connector means comprises a tube 43 of slightly smaller inside diameter than the maximum diameter of handle 32 and which is slidable over the handle in a relatively tight friction fit. Tube 43 may be integral with portion 42. The operator's arm is placed in arm support 41 so his hand rests on or grasps tube 43 and his wrist and forearm nest in curved portion 42. Straps 44 on the support extend over the operator's arm.

During exercising, supports 34 and 41 not only reduce the tendency for muscle spasms, but also firmly hold the limbs in properly aligned position relative to the body in the event the operator has poor muscular control at the elbow and knee joints.

Figure 4:
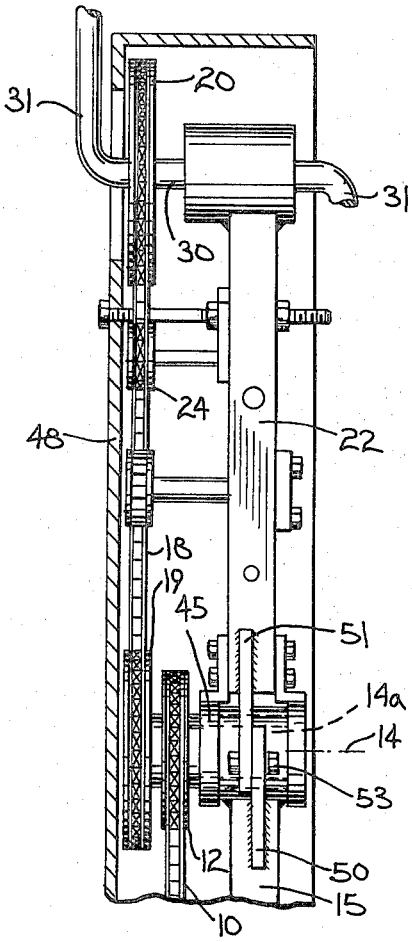
FIG. 4 is a section taken on line 4—4 of FIG. 3.

Referring to FIGS. 3 and 4, the motorized drive connection from chain 10 to chain 18 is provided by a clutch 45 connecting sprocket wheels 12 and 19 on axis 14 and shaft **14*a*. Sprocket wheels 11 and 20 are therefore normally driven at a given speed in unison by motor 4, although the sprocket ratios may provide for different angular velocities of cranks 28 and 31**.

In some instances, and especially when a person's arms are gradually getting stronger, it may be desirable for the operator to be able to temporarily speed up arm rotation manually while maintaining the leg rotation at the set driven speed. For this purpose, clutch 45 is designed to be an overriding clutch so that its output may freely rotate faster than the rotational input. Such a clutch may be of the Sprague type, or that sold as a DC roller clutch and bearing assembly by Torrington. The faster speed may be maintained by the arms until they tire, at which point the motor drive again takes over for them.

The exerciser is adapted to accommodate wheelchair confined persons. For this purpose, and as shown in FIG. 1, the base 1 of the device forms a portion of a flat member which is substantially wider than housing 2 and which extends rearwardly therefrom to form a platform 46 which is very low to the floor and which completely receives the operator's wheelchair 47 thereon. All the operator need do is roll up onto platform 46 from the floor. The weight of the operator 33 and wheelchair 47 on platform 46 stabilizes the entire unit, which would otherwise have to be bolted to the floor.

Depending upon the length of the operator's arms and legs, special adjustments may need to be made between the operator and the exerciser. In the present embodiment, housing 2 comprises an upper portion 48 which extends from above upper sprocket wheel 20 and downwardly to below axis 14, and a lower portion 49 which extends from base 1 and upwardly to adjacent axis 14, with portion 49 telescoping over portion 48 to form a single enclosed chamber containing the drive mechanism.

Figure 5:
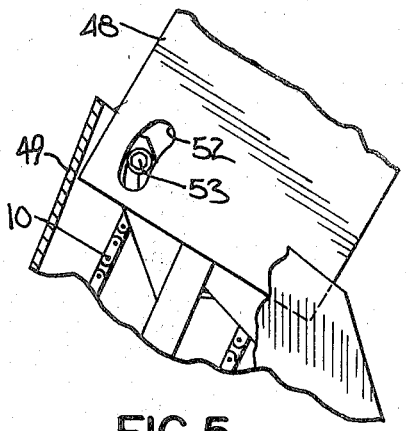
FIG. 5 is a fragmentary detail of the lower portion of the upper housing portion, with parts broken away.

Referring to FIGS. 3–5, a pair of converging arms 50 and 51 are connected at their bases to the respective fixed strut 15 and also strut 22 which is mounted to pivot about axis 14 and shaft **14*a* which extend through the said chamber. The outer ends of arms 50 and 51, as well as the adjacent walls of upper housing portion 48 are provided with co-extensive curved slots 52 spaced from axis 14 and which receive a tightening bolt 53 therethrough. By virtue of the fact that upper housing portion 48, as well as strut 22 are mounted on shaft 14*a*, loosening of bolt 53 will permit pivoting of upper housing portion 48 and the mechanism therein about axis 14, as shown in phantom in FIG. 3. Openings 54 in the opposed walls of lower housing portion 49 permit access to bolt 53**.

The exerciser of the invention provides substantial improvements over prior known exercisers.

Various modes of carrying out the invention are contemplated as being within the scope of the following claims particularly pointing out and distinctly claiming the subject matter which is regarded as the invention.

I claim:

1. An exerciser for disabled persons or the like, comprising in combination:

(a) a frame mounted to a base, (b) rotatable pedal cranks and hand cranks for connection with the limbs of the operator, and with said pedal cranks having pedals rotatably mounted thereon and with said hand cranks having handles thereon, (c) means associated with at least one of said cranks to firmly hold the operator's respective limb in aligned position relative to his body during rotation of said cranks, said holding means comprising:

(1) a generally L-shaped rigid leg support having a flat footrest portion which merges into an elongated curved calf-nesting portion, (2) and means securing said footrest portion to said rotatable pedal, (d) a housing disposed on said frame, (e) and a flexible tether connected between said calf-nesting portion of said leg support and said housing, (f) said flexible tether forming means to hold said leg support against pivoting by gravity into engagement with said base when said rotatable pedal crank is not in use, while freeing said leg support from restraint during use of said pedal crank.

2. An exerciser for disabled persons or the like, comprising in combination:

(a) a frame mounted to a base, (b) rotatable pedal cranks and hand cranks for connection with the limbs of the operator, and with said pedal cranks having pedals rotatably mounted thereon and with said hand cranks having open-ended soft rubber handles thereon, (c) means associated with at least one of said cranks to firmly hold the operator's respective limb in aligned position relative to his body during rotation of said cranks, said holding means comprising:

(1) a generally L-shaped rigid leg support having a flat footrest portion which merges into an elongated curved calf-nesting portion, (2) and means securing said footrest portion to said rotatable pedal, (d) a housing disposed on said frame, (e) a flexible tether connected between said calf-nesting portion of said leg support and said housing, (f) said flexible tether forming means to hold said leg support against pivoting by gravity into engagement with said base when said rotatable pedal crank is not in use, while freeing said leg support from restraint during use of said pedal crank, (g) a rigid arm support having an elongated curved forearm-nesting portion, (h) and a tubular member disposed on one end of said arm support and with said tubular member being frictionally slideable over the open end of a said hand crank handle to provide removable connector means between said arm support and said handle.

3. An exerciser for disabled persons or the like, comprising in combination:

(a) a frame mounted to a base, (b) rotatable pedal cranks and hand cranks for connection with the limbs of the operator, and with said pedal cranks having pedals rotatably mounted thereon and with said hand cranks having open-ended soft rubber handles thereon, (c) means associated with at least one of said cranks to firmly hold the operator's respective limb in aligned position relative to his body during rotation of said cranks, said holding means comprising:

(1) a generally L-shaped rigid leg support having a flat footrest portion which merges into an elongated curved calf-nesting portion, (2) and means securing said footrest portion to said rotatable pedal, (d) a housing disposed on said frame, (e) a flexible tether connected between said calf-nesting portion of said leg support and said housing, (f) said flexible tether forming means to hold said leg support against pivoting by gravity into engagement with said base when said rotatable pedal crank is not in use, while freeing said leg support from restraint during use of said pedal crank, (g) a rigid arm support having an elongated curved forearm-nesting portion, (h) a tubular member disposed on one end of said arm support and with said tubular member being frictionally slideable over the open end of a said hand crank handle to provide removable connector means between said arm support and said handle, (i) motive means, (j) first drive means responsive to said motive means for directly and rotatably driving said pedal cranks, (k) second drive means responsive to said motive means for rotatably driving said hand cranks, (l) and means connecting said second drive means to said first drive means so that said pedal cranks and said hand cranks are driven in unison by said motive means at given speeds, (m) said connecting means including overriding clutch means for permitting only said hand cranks to free wheelingly rotate faster than their said given speed while said pedal cranks continue to be directly driven at their given speed.

4. An exerciser for disabled persons or the like, comprising in combination:

(a) a frame mounted to a base, (b) rotatable pedal cranks and hand cranks for connection with the limbs of the operator, and with said pedal cranks having pedals rotatably mounted thereon and with said hand cranks having open-ended soft rubber handles thereon, (c) means associated with at least one of said cranks to firmly hold the operator's respective limb in aligned position relative to his body during rotation of said cranks, said holding means comprising:

(1) a generally L-shaped rigid leg support having a flat footrest portion which merges into an elongated curved calf-nesting portion, (2) and means securing said footrest portion to said rotatable pedal, (d) a housing disposed on said frame, (e) a flexible tether connected between said calf-nesting portion of said leg support and said housing, (f) said flexible tether forming means to hold said leg support against pivoting by gravity into engagement with said base when said rotatable pedal crank is not in use, while freeing said leg support from restraint during use of said pedal crank, (g) a rigid arm support having an elongated curved forearm-nesting portion, (h) a tubular member disposed on one end of said arm support and with said tubular member being frictionally slideable over the open end of a said hand crank handle to provide removable connector means between said arm support and said handle, (i) motive means, (j) first drive means responsive to said motive means for directly and rotatably driving said pedal cranks, (k) second drive means responsive to said motive means for rotatably driving said hand cranks, (l) means connecting said second drive means to said first drive means so that said pedal cranks and said hand cranks are driven in unison by said motive means at given speeds, (m) said connecting means including overriding clutch means for permitting only said hand cranks to free wheelingly rotate faster than their said given speed while said pedal cranks continue to be directly driven at their given speed, (n) said housing having a fixed lower portion and an upper portion telescoping with said lower portion, said upper portion and said hand cranks being pivotable together about an axis extending through said chamber, (o) a pair of converging arms connected to said frame and disposed adjacent said axis, (p) one of said arms being mounted for pivotal movement with said upper housing about said axis, (q) the outer arm ends and said upper housing having coextensive curved slots disposed therein, (r) and bolt means disposed within said slots for permitting pivoted adjustment of said one arm and said upper housing about said axis.

* * * * *